United States Patent [19]

Ray et al.

[11] Patent Number: 4,757,983

[45] Date of Patent: Jul. 19, 1988

[54] HEAD AND CHIN FOR FACE-DOWN OPERATIONS

[75] Inventors: Charles D. Ray, 19550 Cedarhurst, Wayzata, Minn. 55391; Eugene A. Dickhudt, New Brighton, Minn.

[73] Assignee: Charles D. Ray, Ltd., Wayzata, Minn.

[21] Appl. No.: 898,430

[22] Filed: Aug. 20, 1986

Related U.S. Application Data

[63] Continuation-in-part of Ser. No. 705,897, Feb. 26, 1985, abandoned.

[51] Int. Cl.[4] ..... A61G 13/00

[52] U.S. Cl. ..... 269/328; 5/435; 5/437

[58] Field of Search ..... 269/328; 5/434–437, 5/440; 128/76 R, 133, 134; 254/94

[56] References Cited

U.S. PATENT DOCUMENTS

| | | | |
|---|---|---|---|
| 678,417 | 7/1901 | Muller | 128/76 R |
| 1,776,167 | 9/1930 | Stenshoel | 269/328 |
| 2,057,992 | 10/1936 | Wiruth | 269/328 |
| 2,067,891 | 1/1937 | Comper | 269/328 |
| 2,107,962 | 2/1938 | Sheasby | 5/435 |
| 2,509,086 | 5/1950 | Eaton | 269/328 |
| 2,577,177 | 12/1951 | Anderson . | |
| 2,688,142 | 9/1954 | Jensen | 5/435 |
| 2,803,022 | 8/1957 | Wynkoop | 5/435 |
| 3,114,527 | 12/1963 | Demqrest | 5/435 |
| 3,289,674 | 12/1966 | Platt . | |
| 3,337,883 | 8/1967 | Allison | 269/328 |
| 3,620,395 | 11/1971 | Farmer | 254/94 |
| 3,674,252 | 7/1972 | Crabtree et al. | 254/94 |
| 3,761,058 | 9/1973 | Stone et al. | 254/94 |
| 3,828,377 | 8/1974 | Fary | 269/328 |
| 4,019,727 | 4/1977 | Martin et al. | 269/328 |
| 4,504,050 | 3/1983 | Osborne | 5/435 |

FOREIGN PATENT DOCUMENTS

| | | | |
|---|---|---|---|
| 151305 | 5/1904 | Fed. Rep. of Germany | 5/437 |
| 122855 | 8/1971 | Norway | 5/436 |
| 317583 | 1/1957 | Switzerland | 269/328 |

OTHER PUBLICATIONS

"Andrews Spinal Surgery Frame", Orthopedic Systems Inc., Hayward, Calif.

"The Maquet Operating Table System", Stierlen-Maquet AG, Catalog No. 1120, Germany.

"Shampaine", Affiliated Hospital Products, Inc., St. Louis, Mo., 1983.

"Chick Surgical Table CST Series SE2001", Click Surgical Systems, Inc., Greenwood, S.C.

*Primary Examiner*—Robert C. Watson

[57] ABSTRACT

For face-down operations, a head and chin rest can stand on the flat bed of an operating table and has a frame including cushioned forehead and chin supports, the frame being pivotable to raise or lower the chin support relative to the forehead support. The forehead and chin supports are spaced to make the patient's face almost fully accessible, and that spacing is adjustable to allow for heads of various sizes. Preferably the base which supports the frame has a rocker base, thus permitting the patient to pivot the head and chin rest with his head to the most comfortable attitude, after which the rocker base can be wedged, such as with a small towel.

20 Claims, 3 Drawing Sheets

HEAD AND CHIN FOR FACE-DOWN OPERATIONS

CROSS-REFERENCE TO RELATED APPLICATIONS

This application is a continuation-in-part of copending application Ser. No. 705,897, filed Feb. 26, 1985 now abandoned.

The head and chin rest of the present invention may be used in conjunction with the upper-chest-support cushion disclosed in patent applications Ser. No. 705,891, filed Feb. 26, 1985 (now abandoned), and Ser. No. 853,666, filed Apr. 18, 1986, the latter being a continuation-in-part of the former.

BACKGROUND OF THE INVENTION

1. Field of the Invention

The invention concerns a head and chin rest for face-down operations and especially concerns the need both to avoid patient discomfort and trauma and to provide convenient access by the anesthesiologist to the nose and mouth.

2. Description of Related Art

In face-down operations with the patient in either a prone or prone sitting position, the patient's head is commonly turned to the side even though this puts the cervical spine into an abnormal position and often leaves the patient with a sore neck after a long operation. The sidewise head position constricts the trachea and larynx, thus tending to produce throat soreness when there is a tube in the patient's throat. When the patient is in a prone position, the head can be positioned face-down on an annular cushion that rests on a support cantilevered from the head end of the operating table. However, the prone sitting position requires a kneeling attachment to be fastened to the foot of the operating table, and to use an annular cushion would require a hole to be formed in the bed of the operating table.

The operating table of U.S. Pat. No. 2,577,177 (Anderson) has "a concave head rest 31 to engage the forehead of a patient" (col. 4, lines 52–53) which enables the head to be face-down and also provides good access to the nose and mouth. U.S. Pat. No. 3,289,674 (Platt) shows in FIG. 1 a similar forehead cushion 108, but both of those head rests leave the chin unsupported, thus producing a lordotic curve in the cervical spine and resulting in problems similar to the consequences of turning the head sidewise. U.S. Pat. No. 2,509,086 (Eaton) shows a head rest which, like those of the Anderson and Platt patents, leaves the chin unsupported. The Eaton device includes a platform enabling the patient's head to be positioned over the middle of the bed of an operating table.

U.S. Pat. No. 3,144,527 (Demarest) shows a "Body Member Rest" from which is cantilevered a bracket that carries a forehead support and a chin support for a person in a prone, face-down position. Combined forehead and chin supports for a face-down person are also shown in U.S. Pats. Nos. 2,688,142 (Jensen) and 4,504,050 (Osborne), but neither is said to be useful for face-down operations and would not be since neither affords good access to the nose and mouth.

SUMMARY OF THE INVENTION

The present invention concerns a head and chin rest for face-down operations which allows the patient's head, chin and neck to be comfortably supported in a natural position while affording excellent access to the nose and mouth. Briefly, the novel head and chin rest comprises:

- a base,
- a frame mounted on the base and including a rigid forehead support and a rigid chin support which are spaced to make the patient's face almost fully accessible,
- a contoured cushion mounted on each of the forehead and chin supports,
- means for pivoting the frame to raise or lower the chin support relative to the forehead support, and
- means for adjusting the spacing between the forehead and chin supports.

The novel head and chin rest can have a stationary base with the frame pivotably mounted on the base. Such a frame can be pivoted at the forehead support, with said means for adjusting the spacing including a pair of thin rails by which the chin support is telescopically cantilevered from the forehead support. The telescopic cantilevering permits the chin rest to be moved in and out to fit heads and faces of various sizes and then locked in position. By pivoting the head and chin rest at the forehead support, the patient's chin can be raised or lowered relative to the forehead. The base should extend beneath the chin support and includes resilient feet allowing it to stand on a flat operating table surface.

A preferred embodiment of the invention has a rocker base such as a pair rockers. The rockers permit the patient to pivot the head and chin rest with his head to the most comfortable attitude, after which the rockers can be wedged, such as with a small towel. In the rocking embodiment, the aforementioned means for adjustably spacing the forehead and chin supports may be provided by slidably mounting the chin support on the fraame of the rocker base.

In each of the aforementioned embodiments, each of the forehead and chin supports preferably includes a rigid platform to which a contoured cushion may be removably attached. Each cushion may be a stiff, foamed plastic carrying a layer of repositionable pressure-sensitive adhesive on its lower face. Each of the platforms preferably is flat, both for economy of manufacture and also to make it easier to mount and remove the cushions. The cost of the cushions should be sufficiently low to permit them to be disposable after each operation, while each of the base, forehead support and chin support may be metal for cleanliness.

BRIEF DESCRIPTION OF THE DRAWING

In the drawing, each figure of which is schematic.

Figure 1:
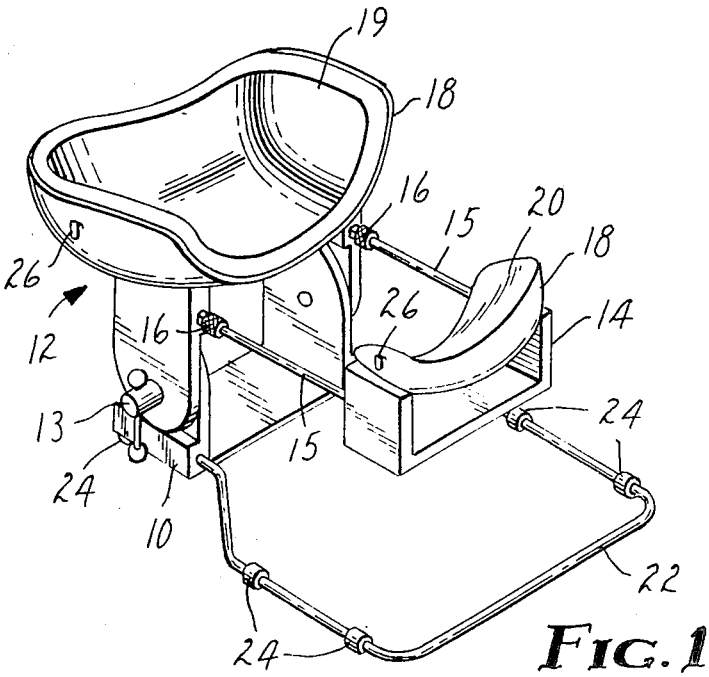
FIG.1 is a perspective view of a first head and chin rest of the invention.

The head and chin rest shown in FIG. 1 has a stationary, rigid base 10 pivotably supporting a frame including a rigid forehead support 12 and a rigid chin support 14. The frame is pivoted at the forehead support 12, and the chin support 14 is cantilevered from the forehead support 12 by a pair of metal rails 15 which telescopically fit into knurled locking nuts 16 that project from the forehead support 12. The locking nuts 16 permit the rails to be locked at infinitely differing spacings between the forehead and chin supports. A clamp 13 cooperates with hidden detents to prevent the forehead support from pivoting until it is unlocked. Each of the forehead and chin supports has a rigid concave platform 18 formed from sheet metal and into which are fitted disposable contoured blocklike cushions 19 and 20, respectively. Fixed within openings in the base 10 are the ends of a generally U-shaped rod 22 which extends beneath the chin support 14 to prevent the head and chin rest from tipping. The base 10 and its rod 22 have six resilient feet 24 allowing the head and chin rest to be stably positioned on a flat operating table. Fixed to the sides of each concave platform 18 are two hooks 26 for securing the straps of an anesthetic mask being worn by the patient.

In a prototype of the head and chin rest shown in FIG. 1, the concave platforms 18 were formed from stainless steel having a thickness of about one mm, and each of the cushions 19 and 20 was 20-pound polyurethane foam without any covering.

Figure 2:
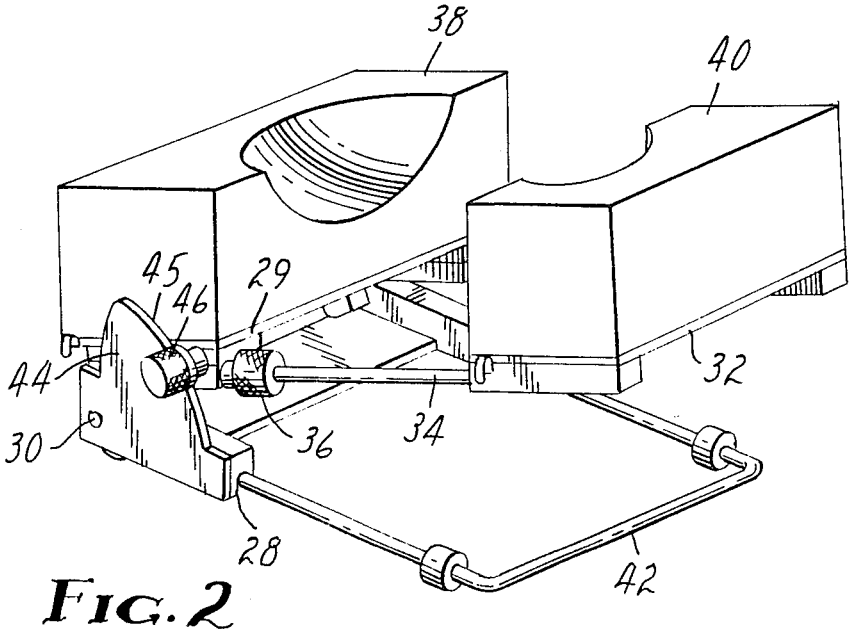
FIG. 2 is a perspective view of a second head and chin rest of the invention.

The head and chin rest of FIG. 2 has a rigid base 28 on which a rigid forehead support 29 is pivotably mounted at a hinge 30. Fixed to a rigid chin support 32 are a pair of metal rails 34, each of which telescopically fits into a knurled locking nut 36 that projects from the forehead support 29, thus cantilevering the chin support from the forehead support. The forehead and chin supports have flat platforms on which are mounted contoured blocklike cushions 38 and 40, respectively. Each of the cushions 38 and 40 may be a block of stiff foamed plastic, e.g., polyurethane, that has a layer of repositionable pressure-sensitive adhesive by which it is attached to its platform. Fixed to the base 28 is a U-shaped rod 42 which extends beneath the chin support 32.

Fixed to each side of the base 28 is a soft-metal sector plate or protractor 44 that can be clamped at any point along its arcuate perimeter 45 by a knurled nut 46 projecting from the side of the platform of the forehead support 29. Not shown are a pair of closely spaced, case-hardened steel pins which have been pressed into holes in each side of the platform immediately beneath the knurled nut 46. When the knurled nuts are tightened, the tips of the steel pins bits into the inward-facing surface of the softer protractor 44 to guard against slippage under the weight of the patient's head. In a prototype of the head and chin rest of FIG. 2, each steel pin had a length of about 5 mm, a diameter of about 1.5 mm, and a rounded tip which protruded about 0.5 mm beyond the surface of the platform.

The head and chin rest of FIG. 2 has a low profile that permits the upper-chest-support cushion to be quite low and hence both inexpensive and laterally stable. The height of the patient's head above the operating table is adjustable by stocking the cushions 38 and 40 in various thicknesses.

Figure 3:
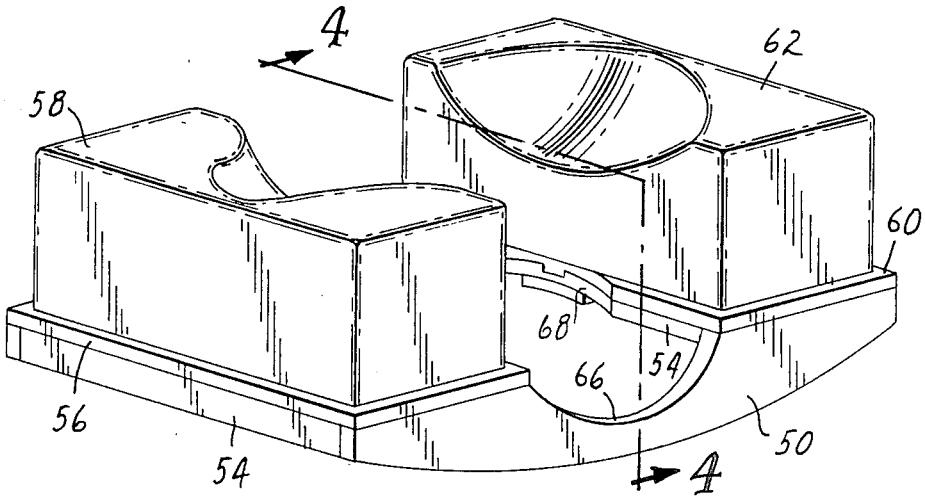
FIG. 3 is a perspective view of a third head and chin rest of the invention.
Figure 4:
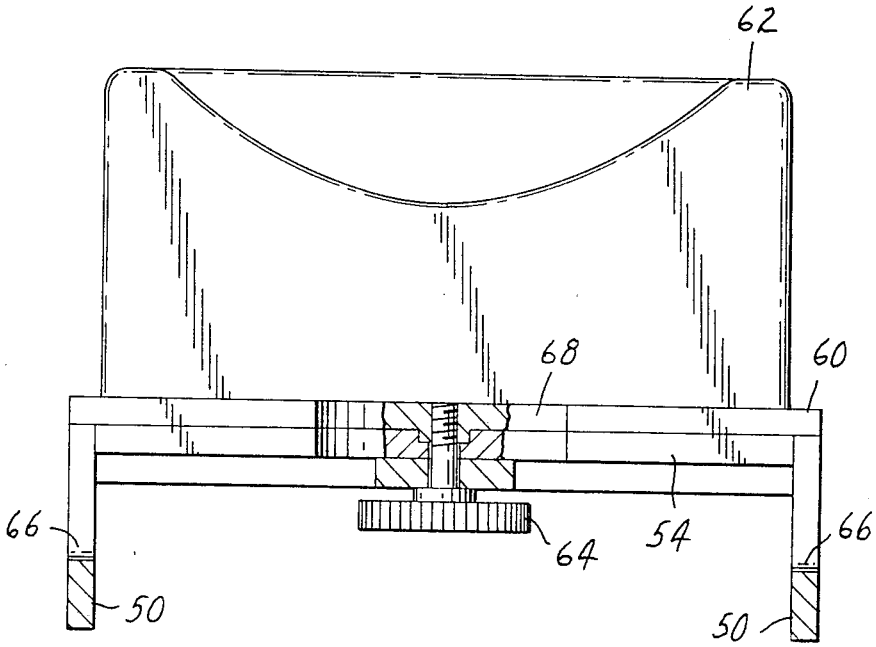
FIG. 4 is a cross section along line 4—4 of FIG. 3.

The head and chin rest shown in FIGS. 3 and 4 has a pair of metal rockers 50 which serve as a rigid base and, together with metal cross pieces 54, provide a rigid frame for a chin support 56 and a forehead support 60, each of which is a flat metal platform. Removably mounted on each of the chin and forehead supports is a disposable, contoured, blocklike, stiff foamed plastic cushion 58 and 62, respectively. The forehead support 60 is slidably mounted on the frame and, after being positioned, can be locked in place by a knurled screw 64. Arcuate cutouts 66 in the rockers 50 help to make the patient's face almost fully accessible.

As can best be seen in FIG. 3, the forehead support 60 has an arcuate concavity 68 which is bridged by the forehead cushion 62. This permits the bridge of a patient's nose to be positioned on the forehead cushion while ensuring against any discomfort from the unyielding underlying metal platform. The chin support has a comparable arcuate concavity (not shown) which with the first arcuate opening 68, if the two platforms could be moved together, would form a symmetrical oval opening.

Figure 5:
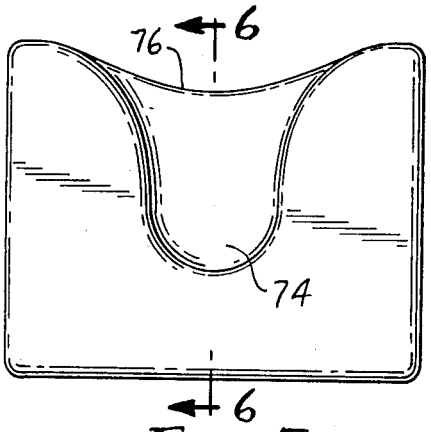
FIG. 5 is a top view of a preferred chin cushion for the head and chin rests of FIGS. 2 and 3.
Figure 6:
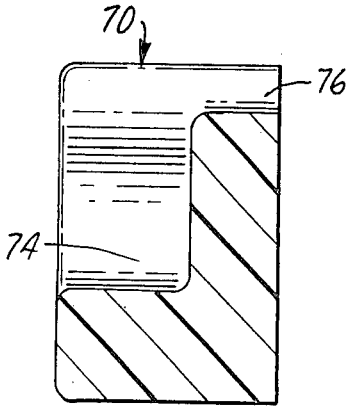
FIG. 6 is a cross section along line 6—6 of FIG. 5.

The blocklike chin cushion 70 of FIGS. 5 and 6 is formed with a deep cavity, at the base of which is a pocket 74 for the mental eminence of the chin where prolonged pressure can cause loss of circulation. By making the cavity deep while forming a frontal depression 76 to leave the patient's lower lip unsupported, pressure from the weight of the head is better distributed along the margins of the mental eminence including the cheeks. Because of the aforementioned arcuate concavity in the chin support, the frontal depression 76 does not expose the underlying metal platform.

When the chin cushion has been formed as shown in FIGS. 5 and 6, one size has thus far fitted every patient. A head which is relatively narrow tends to be light in weight and so doesn't sink very far into the cushion, but because of its light weight it doesn't need much lateral support. On the other hand, a wider, heavier head develops more lateral support from sinking further into the cushion.

Figure 7:
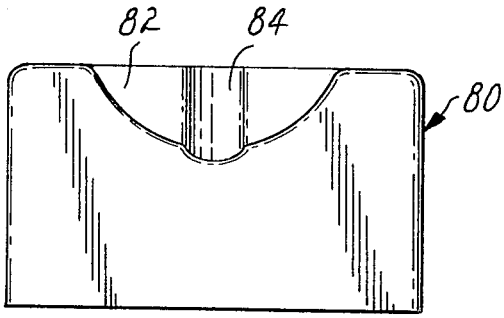
FIG. 7 is a side elevation of a preferred forehead cushion for the head and chin rests of FIGS. 2 and 3.

The blocklike forehead cushion 80 shown in FIG. 7 has a cavity 82 which is shaped to fit the forehead except at a central trough 84 that is formed to avoid undue pressure against the central frontal vein of the forehead.

EXAMPLE 1

Two prototypes of the head and chin rests of FIGS. 1 and 2 have been used in excess of 300 operations without a neck complaint. In response to two early cases of blistering of the skin, the cushions were changed from polyurethane to a stiffer polyethylene foam. Recently, the contours of the chin and forehead cushions have been adjusted for better anatomical conformance as illustrated in FIGS. 5–7, thus better distributing the weight of the head while avoiding undue pressure in certain areas such as the central frontal vein of the forehead.

When using these prototypes, the anesthiologists occasionally lift the patient's head to check for pressure points and the positioning of tubes. Any such check was virtually impossible when using taped pillow supports which are in common use prior to the present invention. The anesthiologists also praise the ability to examine both sides of a patient's face without rotating the head.

EXAMPLE 2

Prototypes are now being constructed as shown in FIGS. 3 and 4 and being fitted with stiff, foamed polyethylene cushions as shown in FIGS. 5–7. Specifically, the cushions were open-cell, polyethylene foam having a density of 1.5 lbs./cu. ft. and molded to form a skin closing the cells at the surface. Each of these prototypes has a radius of 1.3 cm along the edges of the cavities and all other upper edges. These prototypes are proving to be far more economical to manufacture than were those of FIGS. 1 and 2.

We claim:

1. Head and chin rest for supporting a patient's head face-down and comprising:

a base, a frame mounted on the base and including a rigid forehead support and a rigid chin support, a blocklike cushion mounted on each of the forehead and chin supports and having substantially orthogonal sides, a concavity extending inwardly from two adjacent sides of each cushion, that of the forehead cushion being contoured to conform to and support substantially the entire forehead of a face-down patient and that of the chin cushion being contoured to conform to and support substantially the entire chin of the face-down patient, means for adjusting the spacing between the forehead and chin supports and their cushions and making the face-down patient's face almost fully accessible, and means for pivoting the frame to raise or lower the chin support relative to the forehead support.

2. Head and chin rest as defined in claim 1 including means permitting the base to rest stably on a flat surface.

3. Head and chin rest as defined in claim 2 wherein the base is stationary and the frame is pivotably mounted on the base.

4. Head and chin rest as defined in claim 3 wherein the frame is pivoted at the forehead support, and said spacing means comprises a pair of thin rails by which the chin support is telescopically cantilevered from the forehead support.

5. Head and chin rest as defined in claim 4 wherein the base includes a rigid extension beneath the chin support to prevent the head and chin rest from tipping when the base is standing on a flat surface.

6. Head and chin rest as defined in claim 5 wherein said extension comprises a generally U-shaped rod, and the base and rod have resilient feet allowing the head and chin rest to be positioned stably on a flat surface.

7. Head and chin rest as defined in claim 2 wherein said pivoting means includes a clamp which prevents the frame from pivoting on the base until it is unlocked.

8. Head and chin rest as defined n claim 7 having fixed to the side of the base a soft-metal protractor that has an arcuate perimeter along which said clamp can grip the protractor.

9. Head and chin rest as defined in claim 1 wherein said pivoting means pivots the base with the frame.

10. Head and chin rest as defined in claim 9 wherein said base and pivoting means comprises a pair of rockers which permit the patient to pivot the head and chin rest with his head to the most comfortable attitude.

11. Head and chin rest as defined in claim 10 wherein said spacing means includes means for slidably mounting one of said supports on the frame.

12. Head and chin rest as defined in claim 11 wherein each of the forehead and chin supports includes a flat platform, and a cushion of stiff foamed plastic is releasably adhered to each platform.

13. Head and chin rest as defined in claim 12 wherein the plastic of the cushion is polyethylene.

14. Head and chin rest as defined in claim 12 wherein each of the base, forehead support, and chin support is metal.

15. Head and chin rest for supporting a patient's head face-down and comprising:

a base adapted to rest stably on a horizontal surface, a frame mounted on the base and including a rigid forehead support and a rigid chin support which have flat platforms, a small, stiff, blocklike cushion removably positioned on each of the flat platforms and having substantially orthogonal sides, a concavity extending inwardly from two adjacent sides of each cushion, that of the forehead cushion being contoured to conform to and support substantially the entire forehead of a face-down patient and that of the chin cushion being contoured to conform to and support substantially the entire chin of the face-down patient, means for adjusting the spacing between the forehead and chin platforms and their cushions and making the face-down patient's face almost fully accessible, and means for pivoting the frame to raise or lower the chin platform relative to the forehead platform.

16. Head and chin rest as defined in claim 15 wherein the frame is pivoted at the forehead support, and said spacing means comprises a pair of thin rails by which the chin support is telescopically cantilevered from the forehead support.

17. Head and chin rest as defined in claim 16 wherein the forehead support includes means for releasably securing straps of an anesthetic mask.

18. Head and chin rest for supporting a patient's head face-down and comprising:

a rocker base, a frame pivotably mounted on the base and including a forehead support and a chin support which have flat platforms, a small, stiff, blocklike cushion removably positioned on each of the flat platforms and having substantially orthogonal sides, a concavity extending inwardly from two adjacent sides of each cushion, that of the forehead cushion being contoured to conform to and support substantially the entire forehead of a face-down patient and that of the chin cushion being contoured to conform to and support substantially the entire chin of the face-down patient, means for adjusting the spacing between the forehead and chin platforms and their cushions and making the face-down patient's face almost fully accessible, and means for pivoting the frame to raise or lower the chin platform relative to the forehead platform.

19. Head and chin rest as defined in claim 18 wherein said spacing means includes means for slidably mounting one of said platforms on the frame.

20. Head and chin rest as defined in claim 19 wherein each of said cushions is a disposable foamed plastic.

* * * * *

UNITED STATES PATENT AND TRADEMARK OFFICE

CERTIFICATE OF CORRECTION

PATENT NO. : 4,757,983

DATED : July 19, 1988

INVENTOR(S) : Charles D. Ray and Eugene A. Dickhudt

It is certified that error appears in the above-identified patent and that said Letters Patent are hereby corrected as shown below:

In the title of the patent, insert --REST-- after "CHIN".

The correct title of the patent is "HEAD AND CHIN REST FOR FACE-DOWN OPERATIONS."

Signed and Sealed this

Twenty-ninth Day of November, 1988

*Attest:*

DONALD J. QUIGG

*Attesting Officer*

*Commissioner of Patents and Trademarks*